US010179669B2

(12) United States Patent
Korthäuer et al.

(10) Patent No.: US 10,179,669 B2
(45) Date of Patent: Jan. 15, 2019

(54) APPARATUS AND METHOD FOR LABELLING INDIVIDUAL PACKS

(71) Applicant: ESPERA-WERKE GmbH, Duisburg (DE)

(72) Inventors: Marcus Korthäuer, Mülheim an der Ruhr (DE); Peter Wolff, Swisttal-Heimerzheim (DE); Winfried Vicktorius, Duisburg (DE); Ralf Dippe, Duisburg (DE)

(73) Assignee: Espera-Werke GmbH, Duisburg (DE)

( * ) Notice: Subject to any disclaimer, the term of this patent is extended or adjusted under 35 U.S.C. 154(b) by 80 days.

(21) Appl. No.: 15/538,552

(22) PCT Filed: Oct. 12, 2015

(86) PCT No.: PCT/EP2015/073519
§ 371 (c)(1),
(2) Date: Jun. 21, 2017

(87) PCT Pub. No.: WO2016/102093
PCT Pub. Date: Jun. 30, 2016

(65) Prior Publication Data

US 2017/0341799 A1 Nov. 30, 2017

(30) Foreign Application Priority Data

Dec. 22, 2014 (DE) ..... 10 2014 119 391

(51) Int. Cl.
*B65C 9/26* (2006.01)
*B65C 9/28* (2006.01)
(Continued)

(52) U.S. Cl.
CPC ..... *B65C 1/021* (2013.01); *B65C 9/1884* (2013.01); *B65C 9/28* (2013.01); *B65C 1/023* (2013.01); *B65C 9/26* (2013.01); *Y10T 156/1744* (2015.01)

(58) Field of Classification Search
CPC ..... Y10T 156/17; Y10T 156/1702; Y10T 156/1744; B65C 1/02; B65C 1/021;
(Continued)

(56) References Cited

U.S. PATENT DOCUMENTS 5,705,021 A * 1/1998 Wurz ..... B65C 1/021 156/360
5,954,913 A 9/1999 Wurz et al.
(Continued)

FOREIGN PATENT DOCUMENTS

DE 8907855 U1 8/1989
DE 19531426 A1 2/1997
(Continued)

*Primary Examiner* — Carson Gross
(74) *Attorney, Agent, or Firm* — Rankin, Hill & Clark LLP

(57) ABSTRACT

An apparatus and method for labelling packs including an advancement device for transporting a pack in a transporting direction, a dispensing device for dispensing a label into a dispensing position, and an application device for applying the dispensed label to the pack. A punch including a punch shank and punch foot moves the dispensed label from a receiving position, where the punch foot receives the label, to a discharging position, where the label is applied to the pack by the punch foot. The punch shank is pivotally mounted about a first pivot axis transverse to the transporting direction, and is movable axially in a guide element. The punch shank is connected to a lifting element of a lifting device via an articulation. The lifting element is movable parallel to a direction angled relative to the transporting
(Continued)

Figure 1A:
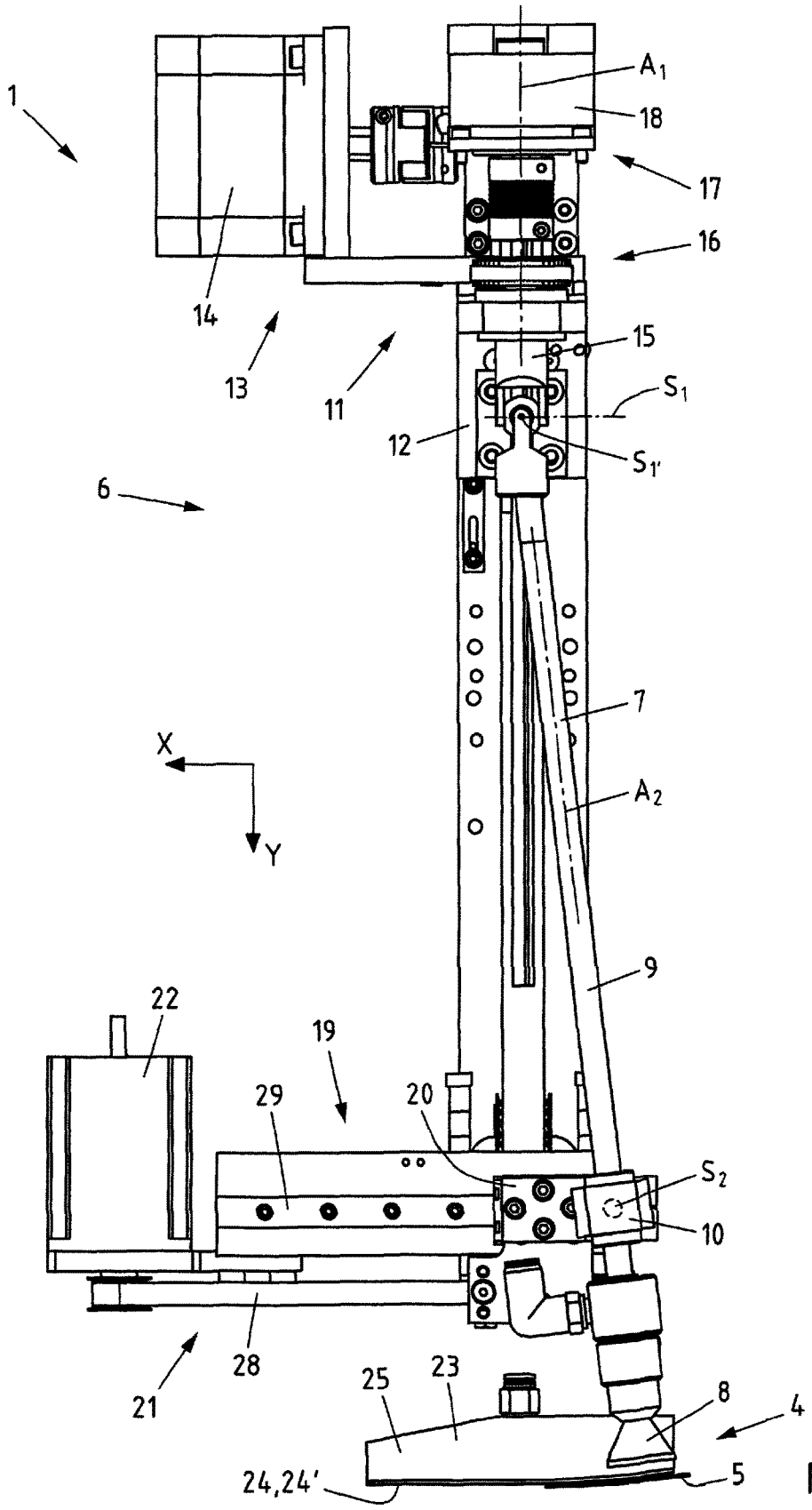

direction. A first drive with a motor drives the lifting element.

21 Claims, 14 Drawing Sheets

(51) Int. Cl.
*B65C 1/02* (2006.01)
*B65C 9/18* (2006.01)

(58) Field of Classification Search
CPC ..... B65C 1/023; B65C 9/1815; B65C 9/1826; B65C 9/1865; B65C 9/1876; B65C 9/1884
USPC ..... 156/230, DIG. 28, DIG. 33, DIG. 37, 156/DIG. 38
See application file for complete search history.

(56) References Cited

U.S. PATENT DOCUMENTS

| | | | |
|---|---|---|---|
| 6,336,492 | B1 | 1/2002 | Nagaoka |
| 2005/0263535 | A1 | 12/2005 | Smith |

FOREIGN PATENT DOCUMENTS

| | | | |
|---|---|---|---|
| DE | 19727648 | A1 | 1/1999 |
| DE | 19821546 | C1 | 8/1999 |
| DE | 19906116 | A1 | 8/2000 |
| DE | 102008032019 | A1 | 1/2010 |
| EP | 0089935 | A1 | 9/1983 |
| EP | 0839725 | A1 | 5/1998 |
| EP | 1293691 | A1 | 3/2003 |
| JP | 2006199325 | A | 8/2006 |
| WO | 9742086 | A1 | 11/1997 |

* cited by examiner

APPARATUS AND METHOD FOR LABELLING INDIVIDUAL PACKS

The present invention pertains to a device for labeling individual packages with a feed mechanism for transporting the respective package in a transport direction, with a dispensing unit for dispensing a label into a dispensing position and with an application unit for applying the dispensed label on the respective package, wherein the application unit comprises a plunger with a plunger shaft and a plunger base for moving the dispensed label from a pick-up position, in which the label is picked up by the plunger base, into a delivery position, in which the label can be applied on the package by the plunger base, wherein the plunger shaft is mounted such that it is pivotable about at least one first pivoting axis extending transverse to the transport direction, wherein the plunger shaft is axially movable in a guide element, and wherein the application unit comprises a lifting apparatus with a lifting element, which can carry out a reciprocating motion parallel to a direction extending angular to the transport direction, and a first drive with a motor that drives the lifting element.

The invention furthermore pertains to a method for labeling individual packages by utilizing such a device.

A corresponding device and a corresponding method are known, for example, from DE 197 27 648 A1. This known device comprises a feed mechanism in the form of multiple conveyor belts that are arranged behind one another in the transport direction, wherein a gap is arranged between two adjacent conveyor belts. A package containing, for example, a product is transported on the conveyor belts in the transport direction that extends horizontally and is also referred to as X-direction below. As soon as the package is located vertically above the gap, a previously printed and dispensed label is applied on the underside of the package from below through the gap.

The labels to be applied on the individual packages initially are detachably attached to a strip of material in the form of a carrier strip that is supplied in a roll. The roll with the labels is unwound in a dispensing unit for dispensing a label and deflected multiple times, wherein the last deflection takes place on a dispensing edge formed by a plate, around which the strip of material extends. Due to the deflection on the dispensing edge, the respective label to be applied detaches from the strip of material and is picked up by a suction base, which is arranged on the vertically upper end of a plunger shaft of the plunger, by generating a vacuum in the suction base. The plunger shaft is connected to the suction base and arranged in a guide tube in an axially movable fashion. The plunger shaft can only carry out slight axial motions within the guide tube. It can carry out so-called short strokes in order to pick up a label from the strip of material at the dispensing edge by means of the suction base connected to the plunger shaft.

After the suction base has picked up the label and the plunger shaft has once again been slightly moved back from the plate and the strip of material in the axial direction, the guide tube is pivoted from the dispensing edge into the region underneath the gap between the two conveyor belts about a pivoting axis extending transverse to the transport direction. For this purpose, the guide tube is mounted in a guide element in a pivotable and axially movable fashion, wherein said guide element is connected to an adjusting apparatus that carries out alternating horizontal motions and thereby causes the pivoting motions of the guide tube. As soon as the suction base is located underneath the aforementioned gap, the entire guide tube is moved in the direction of the gap essentially perpendicular to the transport direction such that the suction base with the label adhering thereto is guided through the gap up to the underside of the package. During this motion of the guide tube, the plunger shaft and the suction base do not carry out an axial motion relative to the guide tube—the latter axial relative motions exclusively serve for picking up the label in the dispensing position.

As soon as the label has been transferred from the suction base to the underside of the package, the guide tube is once again moved back essentially perpendicular to the conveyor belt, i.e. in the direction also referred to as Y-direction below, and pivoted back into the starting position in order to enable the suction base to pick up a new label at the dispensing edge. At this point, a short-stroke motion of the plunger shaft relative to the guide tube is once again carried out as described above in order to pick up a new label from the strip of material.

The above-described device has a relatively complicated design and the labeling process is relatively time-consuming.

The present invention is therefore based on the objective of disclosing a device and a method that make it possible to simplify the labeling of individual packages.

In a device for labeling individual packages with a feed mechanism for transporting the respective package in a transport direction, with a dispensing unit for dispensing a label, particularly a printed label, into a dispensing position and with an application unit for applying the dispensed label on the respective package, in which the application unit comprises a plunger with a plunger shaft and a plunger base, which may be realized in the form of a suction base and/or blow-off base, for moving the dispensed label from a pick-up position, in which the label is picked up by the plunger base, into a delivery position, in which the label can be applied on the package by the plunger base, in which the plunger shaft is mounted such that it is pivotable about at least one first pivoting axis extending transverse to the transport direction, in which the plunger shaft is (mounted) in a guide element such that it is axially movable, i.e. along its longitudinal axis, and in which the application unit comprises a lifting apparatus with a lifting element, which can carry out a reciprocating motion parallel to a direction extending angular to the transport direction, and a first drive with a motor that respectively drives the lifting element or moves the lifting element angular to the transport direction, the above-defined objective is according to a first aspect of the present invention attained in that the plunger shaft of the plunger is connected to the lifting element of the lifting apparatus by means of a joint. This joint therefore allows the pivoting motions of the plunger shaft about the at least one first pivoting axis.

Since the plunger shaft of the plunger is according to the invention connected to a lifting element in an articulated fashion, the plunger shaft can transmit the lifting motions, as well as the pivoting motions, to the plunger base. In this case, the lifting element transmits the alternating lifting motions directly to the plunger shaft via the joint rather than initially transmitting these motions to a guide tube, which in turn is displaceable in a guide element, as it is the case in the prior art. In contrast to the prior art, a separate device for alternately moving the plunger shaft within a guide tube is no longer required. The inventive device for labeling individual packages therefore has a simpler design than corresponding devices known from the prior art. Accordingly, the labeling process is also simplified because the plunger according to the invention no longer consists of a guide tube and a plunger shaft, which have to be moved independently of one another.

Although described in greater detail below, the inventive device functions as follows. Initially, a label is moved into a dispensing position by the dispensing unit. In the dispensing position, the label is particularly located on the side (e.g. the underside) of a holding base of the dispensing unit which faces the feed mechanism. In this dispensing position, the label or at least the majority of the label is not (any longer) connected to the strip of material or carrier strip. The label is then picked up by the plunger base, in particular, directly in the dispensing position that corresponds to the pick-up position in this case. However, it is basically also conceivable that the label is initially moved from the dispensing position into a pick-up position that is spaced apart from the dispensing position parallel to the transport direction (e.g. in the horizontal direction), wherein the plunger base then picks up the label in this pick-up position that differs from the dispensing position. The label is held in the dispensing position and/or pick-up position, e.g., by means of a vacuum, particularly a vacuum generated within the holding base. The label is preferably also held on the plunger base by means of a vacuum during the application motion of the plunger. After picking up the label in the pick-up position, the plunger base is moved in the direction of the feed mechanism and a package transported thereon. The label is applied on the package as soon as the plunger base with the label is located in the close vicinity of the package (distance between plunger base and package 1-60 mm, preferably 5-50 mm, particularly 10-40 mm) or the label and/or the plunger base contacts the package. In a contactless application, the plunger base remains spaced apart from the package and transfers the label, for example, by means of a compressed air blast ejected from the plunger base (this process is also referred to as blowing off the label). After the label has been applied on the package, the plunger is once again moved back into the starting position in order to pick up a new label. The potential motion sequences of the application unit and, in particular, the plunger are described in greater detail below.

According to an embodiment of the inventive device, the plunger base is (in the operating state) immovably connected to the plunger shaft. In other words, the plunger base cannot be moved relative to the plunger shaft during the operation of the device in this embodiment. Nevertheless, the plunger base may in this embodiment be connected to the plunger shaft, in particular, in a detachable fashion such that the plunger base can be advantageously replaced with another plunger base. According to another embodiment, however, it is basically also conceivable that the plunger base is mounted such that it is rotatable relative to the plunger shaft about the longitudinal axis thereof. The plunger base may also be detachably connected to the plunger shaft in this embodiment. In the latter instance, in particular, no further relative motions between the plunger base and the plunger shaft are possible, particularly no axial motions or tilting motions. A rotational motion of the plunger base relative to the plunger shaft may be desirable, for example, if the label should be aligned more precisely prior to its application on the package. However, such an alignment of the label can also be carried out if the plunger base is immovable relative to the plunger shaft during the operation, but the plunger shaft would have to be mounted such that it is rotatable about its longitudinal axis in this case.

According to another embodiment of the device, the latter is ensured in that the joint is a cardanic joint. A cardanic joint particularly has two joint axes (pivoting axes) that extend angular to one another, particularly perpendicular to one another, and preferably intersect such that they lie in the same plane in the idle state of the joint, i.e. when this joint is not deflected. Such a cardanic joint allows a pivoting motion of the plunger or the plunger shaft in a plane, in which the transport direction also extends, namely even if the plunger or the plunger shaft is rotated about its longitudinal axis during the pivoting motion.

According to another embodiment of the inventive device, the plunger shaft and/or the plunger base and/or the joint is/are rotatably mounted, namely in order to allow the above-described alignment of the label. The plunger shaft and/or the plunger base and/or the joint are particularly rotatable about an axis, which extends in the direction that is aligned angular (particularly perpendicular) to the transport direction and in which the lifting element can be moved in a reciprocating fashion, and/or about the longitudinal axis of the plunger shaft. In order to realize the rotational motion, the application unit comprises according to an embodiment a rotating apparatus with a second drive that drives the joint or the plunger shaft or the plunger base. The rotational motion of the joint and/or the plunger shaft and/or the plunger base about the aforementioned axis is therefore caused by the drive. For this purpose, the second drive may comprise a motor that is immovable relative to the motor of the first drive (this refers to the respective motor housing that is respectively immovable relative to the other motor housing). In other words, the motor of the second drive, which is responsible for the rotational motions, is not moved during the reciprocating (alternating) motions of the lifting element. The lifting element therefore moves relative to the motor (motor housing) of the second drive. This has the advantage that the weight of the second motor does not bear on the alternately movable lifting element such that the lifting element can be moved more precisely.

The motor of the first drive and/or the motor of the second drive may consist of a linear motor or stepping motor and/or a DC motor (direct current motor) or EC motor (electronically commutated motor, brushless direct current motor).

If the motor of the second drive consists of a stepping motor, in particular, the joint and/or the plunger shaft and/or the plunger base are according to another embodiment rotatable in increments between 0.5 and 2.5°, preferably between 0.5 and 2°, particularly between 1 and 1.5°. It is preferred to use 1° increments. In this way, the label can be optimally aligned (adjusted) relative to the package as soon as it is picked up by the plunger base.

According to another embodiment of the inventive device, the guide element is mounted such that it is pivotable about a second pivoting axis, which extends transverse to the transport direction and particularly is spaced apart from the joint and/or from the at least one first pivoting axis. Analogous to the transport direction, the direction extending transverse to the transport direction preferably also refers to a horizontal direction. In other words, the feed mechanism or a conveyor belt or the like of the feed mechanism extends in the transport direction and in said direction transverse to the transport direction, which is also referred to as Z-direction below.

According to another embodiment, the guide element can be moved in a reciprocating fashion parallel to the transport direction together with the second pivoting axis, wherein the application unit comprises an adjusting apparatus with an adjusting element, which can be moved in a reciprocating fashion parallel to the transport direction, and a third drive with a motor that drives the adjusting element. In other words, the third drive causes the motion of the adjusting element parallel to the transport direction. The motor of the third drive may also consist of a linear motor or stepping motor. The motor of the third drive particularly is also immovable relative to the motor of the first drive (which once again refers to the respective motor housing).

Consequently, the plunger and the plunger shaft are preferably acted upon by the lifting apparatus for the motions taking place angular to the transport direction and/or by the rotating apparatus for the rotational motions and/or by the adjusting apparatus for the motions taking place parallel to the transport direction (pivoting motions). The plunger base can be guided along a circulation path, which passes the pick-up position (in which the label is picked up) and the delivery position (in which the label is applied on the package), with the aid of the lifting apparatus and the adjusting apparatus. In this case, the plunger base preferably passes the pick-up position in one direction only, particularly in the direction from the pick-up position to the feed mechanism. The plunger base preferably does not pass the pick-up position during the return motion, which begins in the delivery position, such that a new label advantageously can already be moved into the pick-up position or positioned therein during the return motion.

According to another embodiment of the inventive device, the dispensing unit comprises an aforementioned holding base for holding the dispensed label in the dispensing position and, in particular, also in the pick-up position.

The holding base particularly is immovable relative to the motor or motor housing of the first drive. On its side facing the feed mechanism or the package, the holding base comprises at least one contact surface for the dispensed label. In other words, the dispensing position and the pick-up position lie on the side of the holding base facing the feed mechanism. In this case, the label preferably rests against the respective contact surface with its non-adhesive side. The adhesive side on the other hand faces the feed mechanism or the package.

According to an embodiment, the holding base comprises two skids that are spaced apart from one another transverse to the transport direction, wherein each of these skids comprises a contact surface for the dispensed label, particularly on its side facing the feed mechanism or the package. The holding base and/or a skid, preferably both skids, may comprise openings in the region of the contact surface, through which the dispensed label to be applied can be held with the aid of a vacuum. Corresponding openings may also be provided in the plunger base in order to pick up the label by means of a vacuum and/or blow off the label by means of an overpressure.

The distance between the skids is preferably variable in the direction transverse to the transport direction (Z-direction). The holding base can be optimally adapted to different sizes of labels by varying the distance, particularly the horizontal distance, between the skids. It is additionally or alternatively also possible to adjust the plunger or the application unit, namely at least the room of the application unit, to which the plunger is connected, relative to the holding base and/or the skids in the direction extending transverse to the transport direction. The plunger or the application unit or the part of the application unit connected to the plunger preferably can be respectively aligned centrally relative to both skids in said Z-direction. This allows an adaptation of the device or the application unit to different label sizes, particularly different label widths. For example, it is particularly advantageous if the plunger comes in contact with the label in the label center. For this purpose, it would basically also be possible to respectively adapt the device or the application unit to different label length, particularly in that the plunger shaft (and therefore also the plunger base) can be individually positioned in the X-direction or the direction of the pivoting motion of the plunger shaft for each label length.

According to yet another embodiment, an adaptation to different label sizes can also be realized by designing the plunger base in an exchangeable fashion. In this case, it is also immovably connected to the plunger shaft during the operation of the device, i.e. in the operating state, but can be detached, for example unscrewed.

It was already mentioned above that the label is preferably picked up in the pick-up position by the plunger base in a state, in which the label is no longer connected to the strip of material or carrier strip. In this way, the plunger or the plunger base can be respectively guided in the direction of the feed mechanism directly through the pick-up position and does not have to be initially guided past the pick-up position in the horizontal direction before it can be moved in the direction of the feed mechanism as it is the case in the prior art. The application process is thereby significantly shortened in comparison with the prior art.

In a method for labeling individual packages by utilizing a device of the type described above, the above-defined objective is according to a second aspect of the present invention furthermore attained in that the plunger base is starting from the pick-up position directly moved in a direction extending angular to the transport direction in order to apply the dispensed label, and in that the plunger base is guided past the front side of the dispensing unit, particularly the holding base, with respect to the transport direction after the label has been applied on the package in the delivery position.

In this context, front side means that the plunger base is guided past the front end of the dispensing unit or of the holding base, which points in the transport direction.

The latter has the advantage that the plunger base cannot collide with a new label, which is already in the dispensing position and/or pick-up position, during the return motion of the plunger.

According to an embodiment of the inventive method, it is proposed that the plunger base is guided along a circulation path, which does not touch or intersect at any point and, in particular, is essentially oval, during its entire motion from the pick-up position into the delivery position and back into the pick-up position. In sections with a curvature, the circulation path particularly is always curved in the same direction. In fact, the entire circulation path is preferably curved. Such a circulation path is achieved in that a pivoting motion of the plunger shaft (or a translatory motion of the adjusting element of the adjusting apparatus) and a translatory motion of the lifting element of the lifting apparatus are simultaneously carried out, preferably during the motion of the plunger base from the pick-up position into the delivery position (application motion) and/or during the motion of the plunger base from the delivery position back into the pick-up position (return motion).

According to another embodiment of the inventive method, it is proposed that the plunger base is spaced apart from the package by 1-60 mm, preferably 5-50 mm, particularly 10-40 mm, in the direction extending angular to the transport direction during the transfer of the label to the package, i.e. in the delivery position, and that the plunger base particularly blows off the label on the package.

According to another embodiment of the inventive method, it is furthermore proposed that the plunger base is rotated about the longitudinal axis of the plunger shaft, particularly in increments, during its motion from the pick-up position into the delivery position and/or during its motion from the delivery position into the pick-up position.

According to yet another embodiment of the inventive method, it is alternatively proposed that the distance between the skids and/or between at least one of the skids and the plane, in which the plunger shaft carries out its pivoting motion (plane extending parallel to the transport direction), is varied before the plunger base comes in contact with (picks up) the respective (dispensed) label.

Figure 2A:
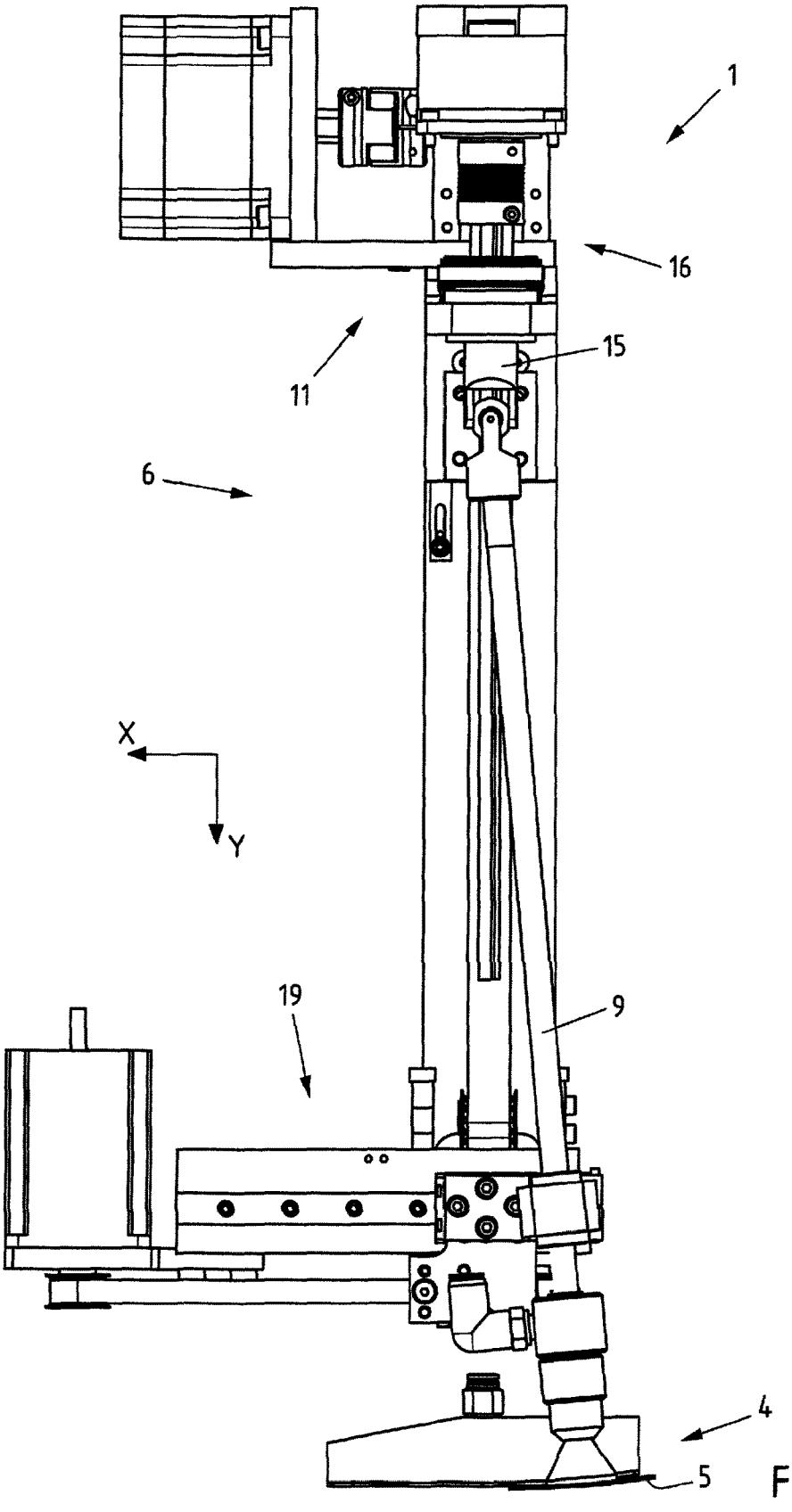
Figure 3A:
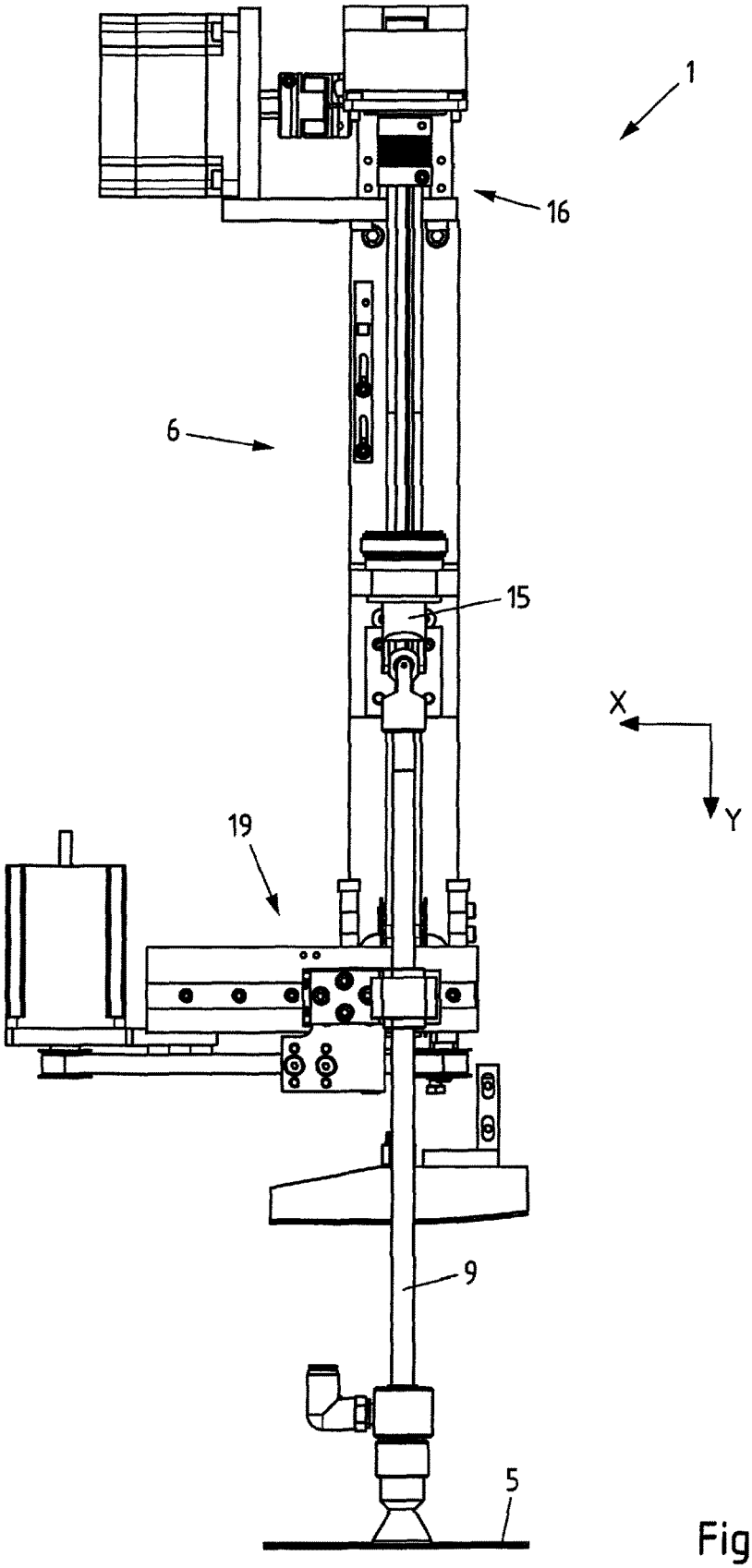
Figure 4A:
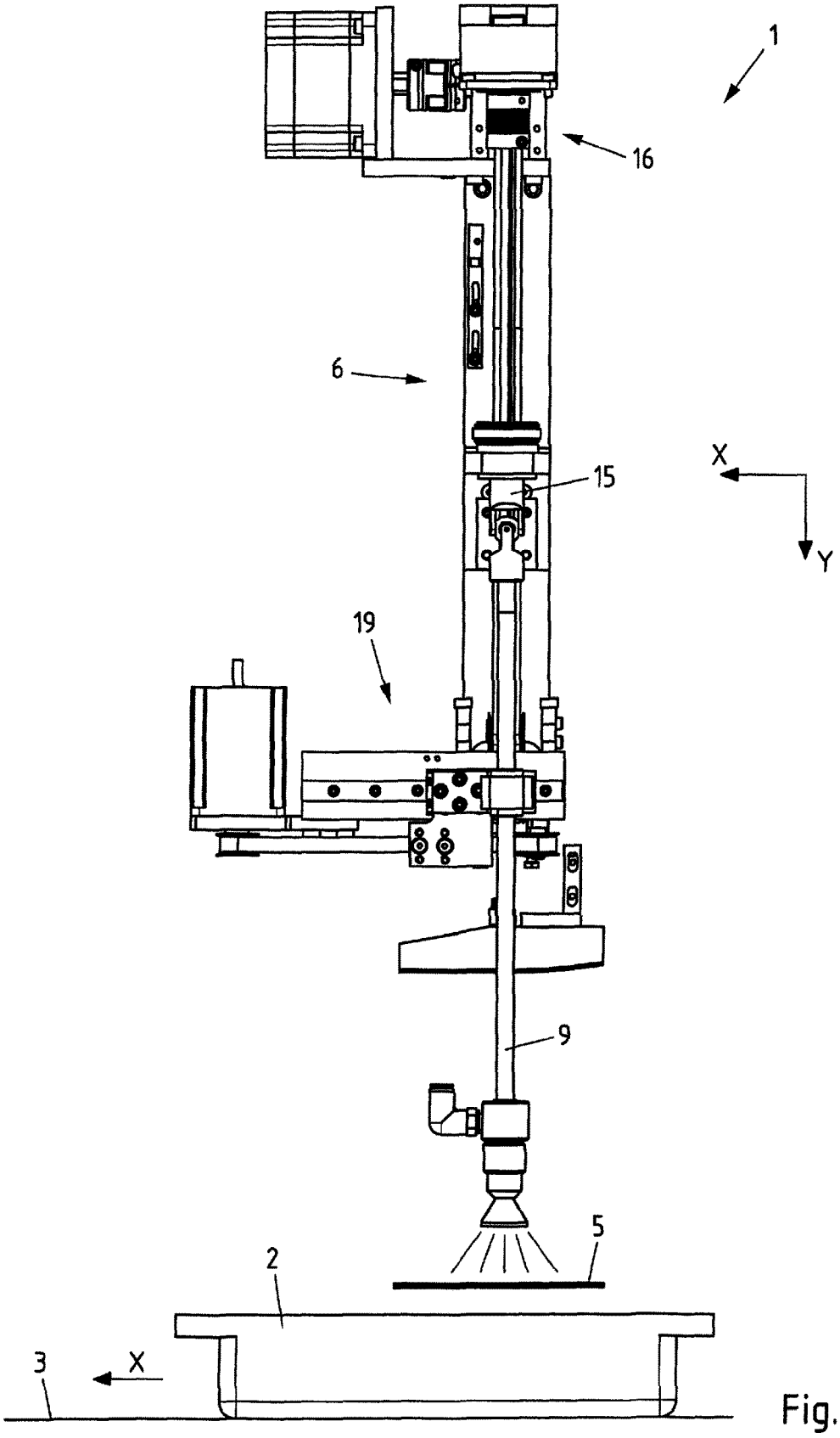
Figure 4B:
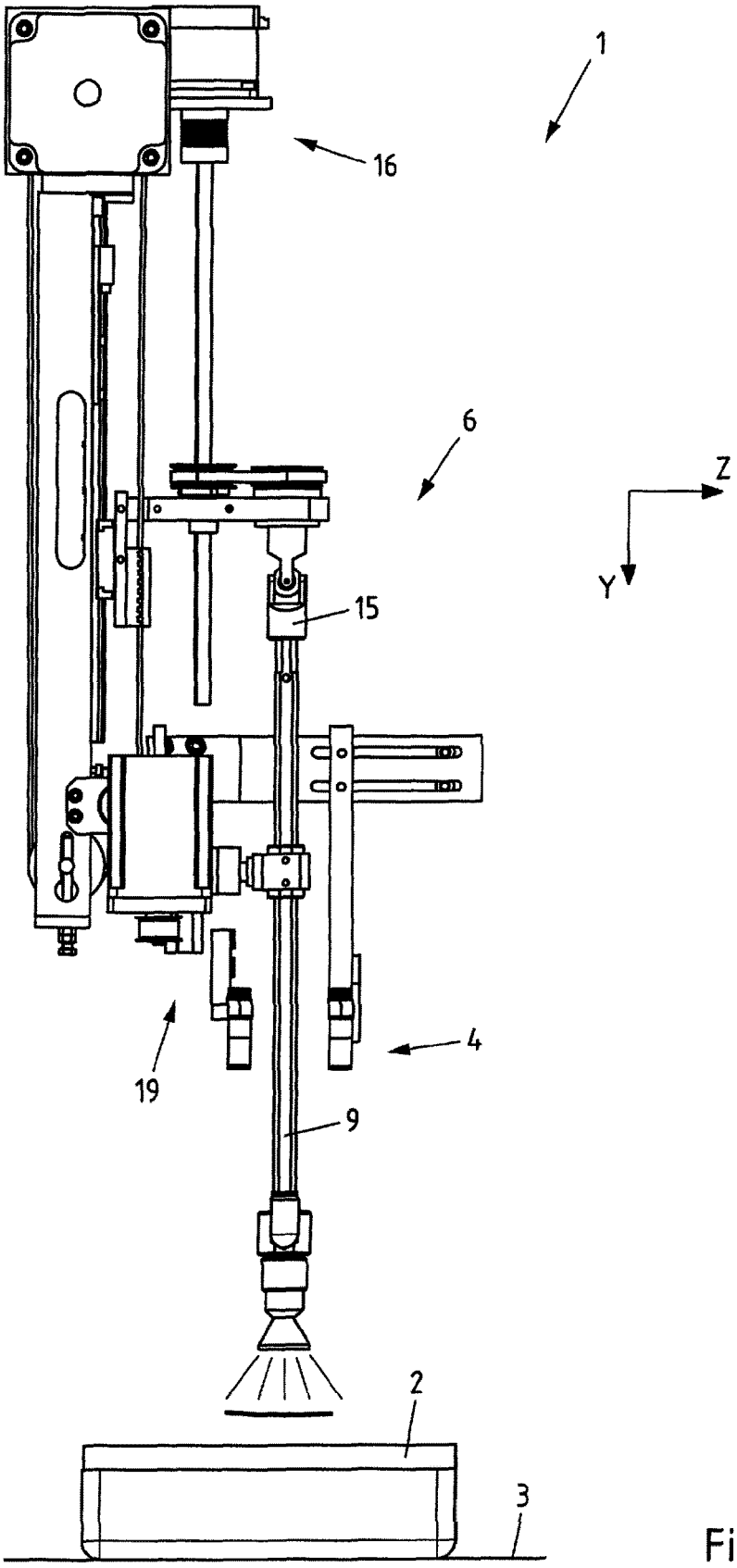
Figure 5A:
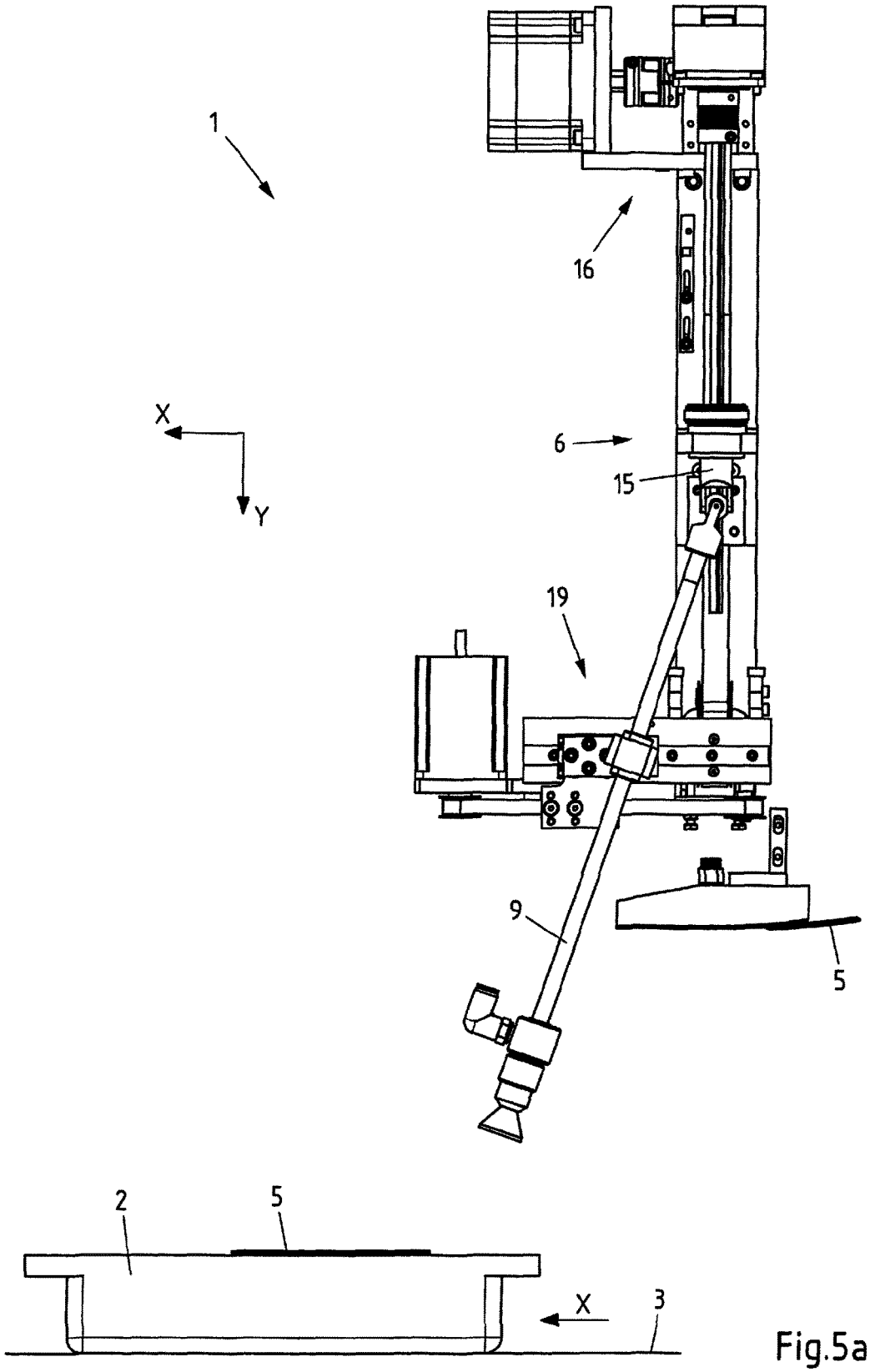
Figure 5B:
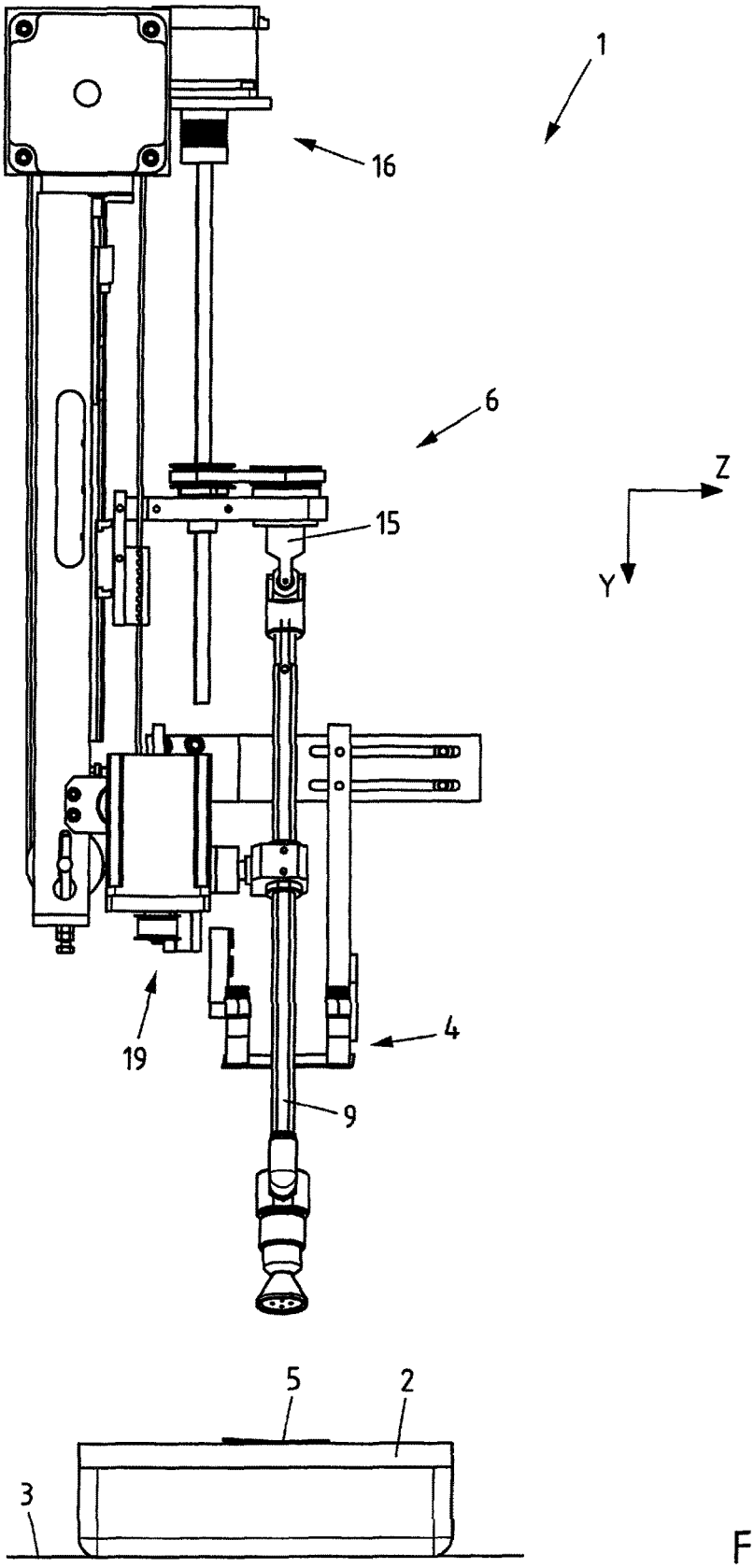
Figure 6A:
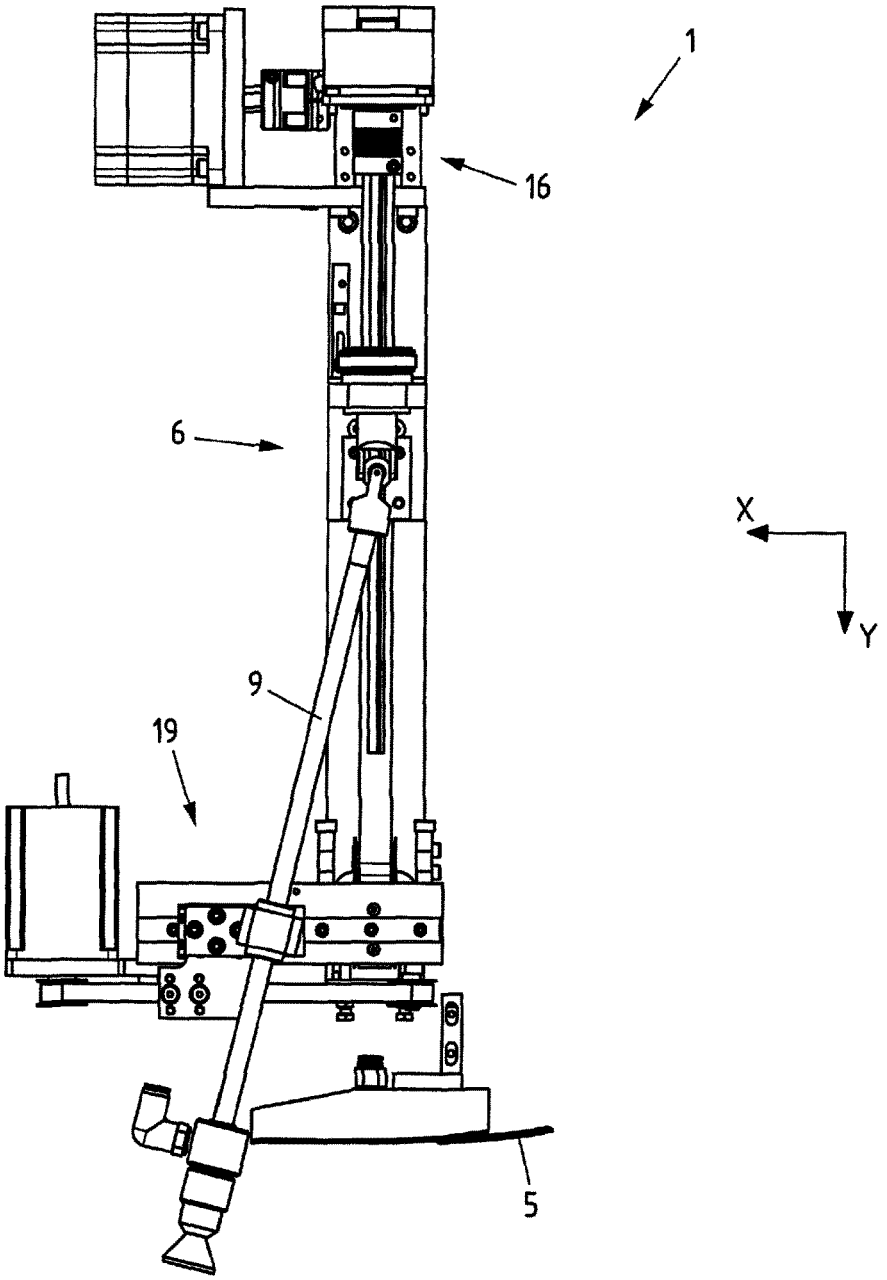
Figure 6A:
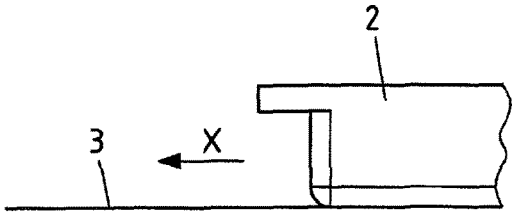
Figure 6B:
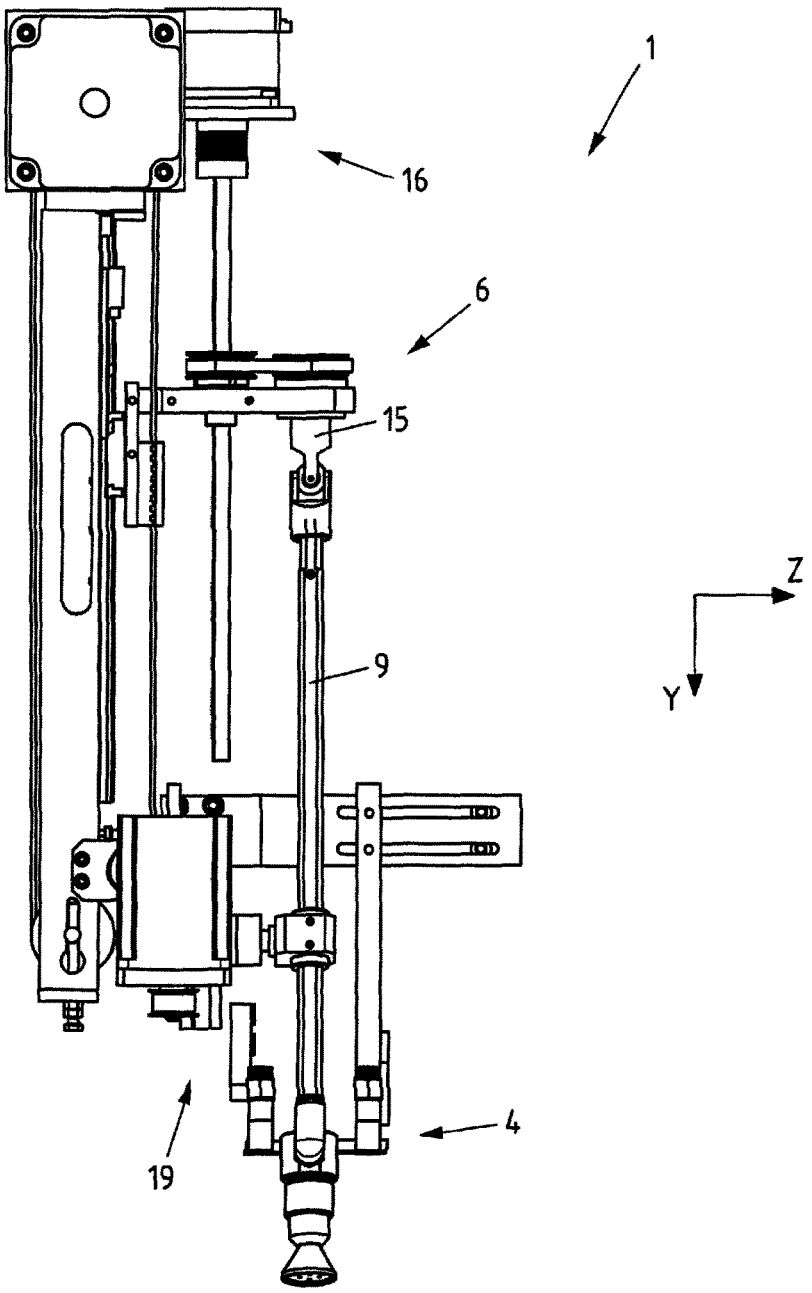
Figure 6B:
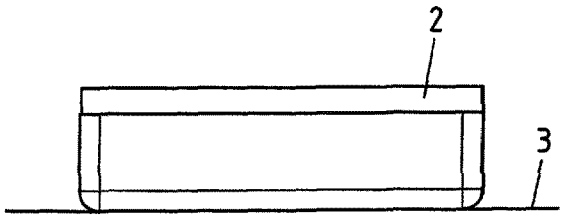
Figure 7A:
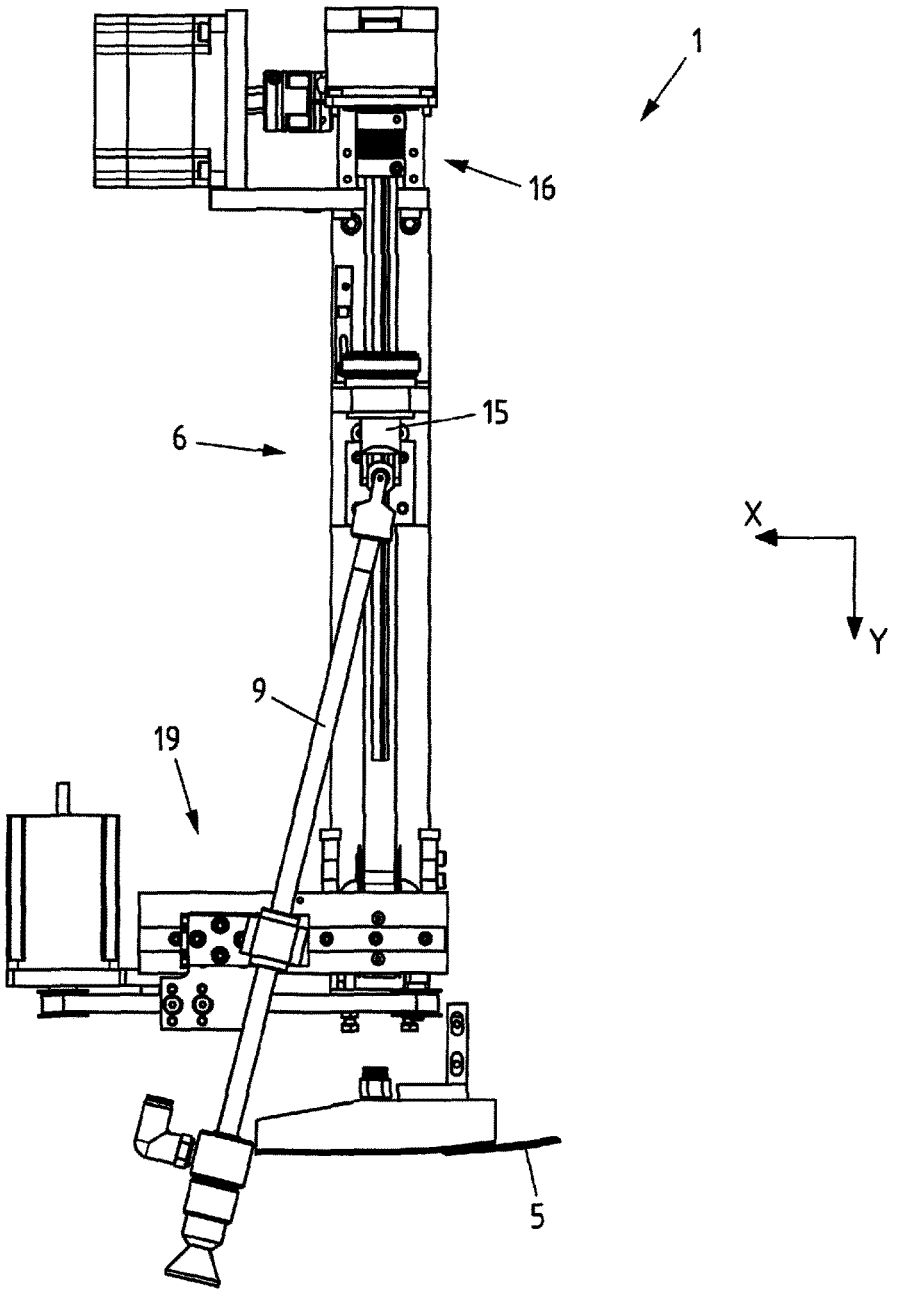
Figure 7A:
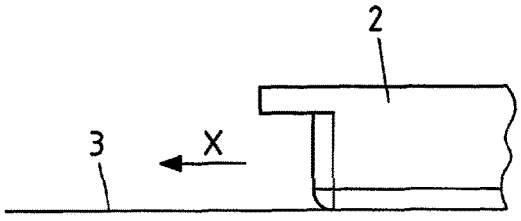
Figure 7B:
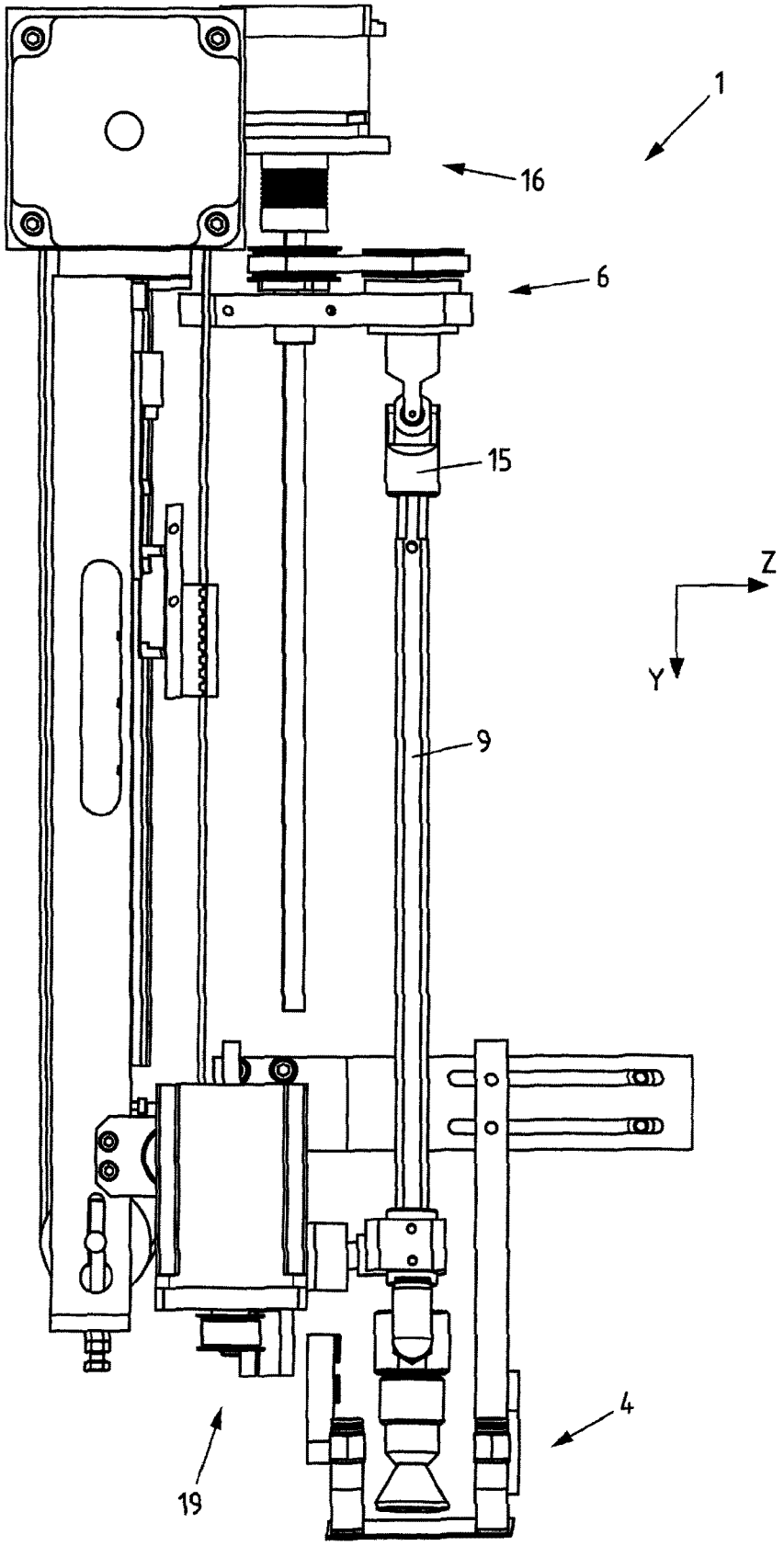

The inventive device and the inventive method can be realized and enhanced in many different ways. In this respect, we refer to the claims, which are respectively dependent on claims 1 and 16, on the one hand and to the description of an exemplary embodiment with reference to the drawings on the other hand. In these drawings:

FIGS. 1*a*) and *b*) show two schematic views of an inventive device prior to picking up a label in viewing directions extending orthogonal to one another, FIGS. 2*a*) and *b*) show two schematic views of the device at the time, at which the label is picked up, in viewing directions extending orthogonal to one another, FIGS. 3*a*) and *b*) show two schematic views of the device during the application motion in viewing directions extending orthogonal to one another, FIGS. 4*a*) and *b*) show two schematic views of the device during the application of the label on a package in viewing directions extending orthogonal to one another, FIGS. 5*a*) and *b*) show two schematic views of the device during a first segment of a return motion after the application of the label in viewing directions extending orthogonal to one another, FIGS. 6*a*) and *b*) show two schematic views of the device during a second segment of the return motion after the application of the label in viewing directions extending orthogonal to one another, and FIGS. 7*a*) and *b*) show two schematic views of the device during a third segment of the return motion after the application of the label in viewing directions extending orthogonal to one another.

FIG. 1*a*) shows a side view of a device 1 for labeling packages 2 that may contain products.

The device 1 comprises a dispensing unit 4 for dispensing a printed label 5 into a dispensing position. In this case, the dispensing position is defined as the position, in which the label 5 is singularized and has been at least predominantly or completely detached from a potentially provided carrier strip, to which it was previously attached together with other labels. Only a holding base 23 of the dispensing unit 4 is illustrated in the figures, wherein the respective label 5 to be applied adheres to said holding base due to a vacuum generated therein. However, the dispensing unit may also comprise a printer and/or a dispensing edge for deflecting a potential carrier strip.

The device 1 furthermore comprises an application unit 6 for applying the dispensed label 5 on the respective package 2. The application unit 6 is described in greater detail below.

A feed mechanism 3 (only illustrated in FIGS. 4*a*) to 7*b*)) ultimately also forms part of the device 1 and serves for transporting the packages 2 to be labeled in a transport direction X. The feed mechanism may comprise, for example, one or more conveyor belts, on the upper side of which the packages 2 are arranged.

The application unit 6 comprises a plunger 9, a lifting apparatus 11, a rotating apparatus 16 and an adjusting apparatus 19.

The plunger 9 comprises a plunger shaft 7 extending along a longitudinal axis $A_2$, as well as a plunger base 8, and serves for moving a dispensed label 5 from a pick-up position (of the label or plunger base) into a delivery position (of the label or plunger base). The pick-up position is the position, in which the label 5 is picked up by the plunger base 8, and may be identical to the dispensing position, in which a label 5 is made available after it has been singularized and, if applicable, detached from a carrier strip. The delivery position is the position, in which the label 5 can be applied on the package 2 by the plunger base 8 (FIGS. 4*a*) and *b*)).

The plunger shaft 7 is mounted such that it is pivotable about a first pivoting axis $S_1'$ extending transverse to the transport direction X. The pivoting axis $S_1'$ is formed by a cardanic joint 15. If the cardanic joint 15 is rotated by 90° about the axis $A_1$, the plunger shaft 7 is pivotable about the first pivoting axis $S_1$, which then likewise extends transverse to the transport direction X. The pivoting motion may also take place about a virtual first pivoting axis if neither of the two pivoting axes $S_1$ and $S_1'$ extends exactly transverse to the transport direction X.

The plunger shaft 7 is furthermore mounted such that it is axially movable in a guide element 10, i.e. the plunger shaft 7 can be moved relative to the guide element 10 in the direction of its longitudinal axis $A_2$. The guide element 10 is the only guide element for the plunger 9 and the only additional bearing (fixing element) for the plunger 9 or the plunger shaft 7 other than the joint 15.

The application unit 6 comprises a lifting apparatus 11 in order to cause such an axial motion of the plunger shaft 7 within the guide element 10. The lifting apparatus 11 comprises a lifting element 12 that is movable parallel to the direction Y, which extends perpendicular to the transport direction X. A drive 13 furthermore forms part of the lifting apparatus 11. The drive 13 comprises a motor 14 and serves for driving the lifting element 12. The latter is easily distinguishable in a comparison between FIGS. 1*b*), 2*b*) and 3*b*) etc. The motor 14 drives a synchronous belt 26, on which the lifting element 12 is fastened. The lifting element 12 comprises a horizontal section 12*a*, which is guided on a guide rod 27 extending in the Y-direction and on which the joint 15 is arranged. When the drive 13 is actuated, the synchronous belt 26 either moves in or opposite to the Y-direction and consequently causes a corresponding motion of the section 12*a* of the lifting element 12 and thereby of the plunger 9.

The plunger 9 can also carry out a pivoting motion simultaneously with the translatory motion in or opposite to the Y-direction. For this purpose, the guide element 10 is mounted such that it is pivotable about a second pivoting axis $S_2$, which extends transverse to the transport direction X, i.e. in a direction Z, and is spaced apart from the joint 15 and the first pivoting axis $S_1$ or $S_1'$. The guide element 10 is rotatably connected to an adjusting element 20 of an adjusting apparatus 19 and can be moved in a reciprocating fashion thereby parallel to the transport direction X together with the second pivoting axis $S_2$. The adjusting apparatus 19 comprises a drive 21 with a motor 22 and a synchronous belt 28 for this purpose. The adjusting element 20 is guided in a guide extending parallel to the transport direction X on the one hand and rigidly connected to the synchronous belt 28 on the other hand. When the drive 21 is actuated, the synchronous belt 28 and therefore the adjusting element 20 move in or opposite to the transport direction X. This motion is transmitted to the guide element 10 that in turn carries out a pivoting motion about the axis $S_2$ due to the plunger shaft 7, which is guided therein and rigidly connected to the joint 15. The motions of the adjusting element 20 and the guide element 10 are particularly distinguishable in a comparison between FIGS. 2*a*), 3*a*) and 5*a*), etc.

The cardanic-mounted plunger 9 can be moved solely by means of the above-described lifting apparatus 11 and adjusting apparatus 19 such that the plunger base 8 or the label 5 adhering thereto carries out a circulatory motion from the pick-up position (FIGS. 1*a*) to 2*a*)) into a delivery position (FIGS. 3*a*) to 4*b*)) and back again via several return positions (5*a*) to 7*b*)) until the starting position (FIGS. 1*a*) and *b*)) is once again reached.

The plunger 9 initially moves from the starting position illustrated in FIG. 1*a*) to the center of the label 5 (FIGS. 1*a*) and *b*)). The plunger base 8, which is realized in the form of a suction and blow-off base in this case, then picks up the label 5 (FIGS. 2*a*) and *b*)) by generating a vacuum. The plunger 9 is then additionally moved such that the label 5 and the plunger base 8 are located vertically above a package 2, wherein the plunger shaft 7 is in this position, which is also referred to as delivery position, preferably aligned exactly perpendicular to the transport direction X and the transverse direction Z and/or the label 5 is aligned parallel to the transport direction X. In this delivery position, in which the plunger base 8 is spaced apart from the upper side of the package 2, for example, by a distance of 10-40 mm, an abrupt overpressure is generated in the plunger base 8 such that the label 5 is blown off and thereby transferred to the upper side of the package 2 (FIGS. 4*a*) and *b*)). After the label 5 has been applied to the upper side of the package 2, a return motion is carried out, during which the plunger base 8 initially is additionally moved in the transport direction X and at the same time vertically upward in the Y-direction (FIGS. 5*a*) and *b*)). In this case, the plunger base 8 describes an arc and continues to follow the above-described circulation path. During this return motion, the plunger base 8 is guided past the outer (front) edge of the dispensing unit 4 or the holding base 23 pointing in the transport direction X such that the plunger base 8 cannot collide with a new label 5, which already adheres to the holding base 23, during its return motion (FIGS. 6*a*) and *b*)). The latter furthermore has the advantage that labels 5, which are longer than those illustrated in the figures, can also adhere to the holding base 23 during the return motion. The plunger 9 is then once again moved opposite to the transport direction X during the return motion (FIGS. 7*a*) and *b*)) and ultimately reaches the starting position again (FIGS. 1*a*) and *b*)).

Figure 1B:
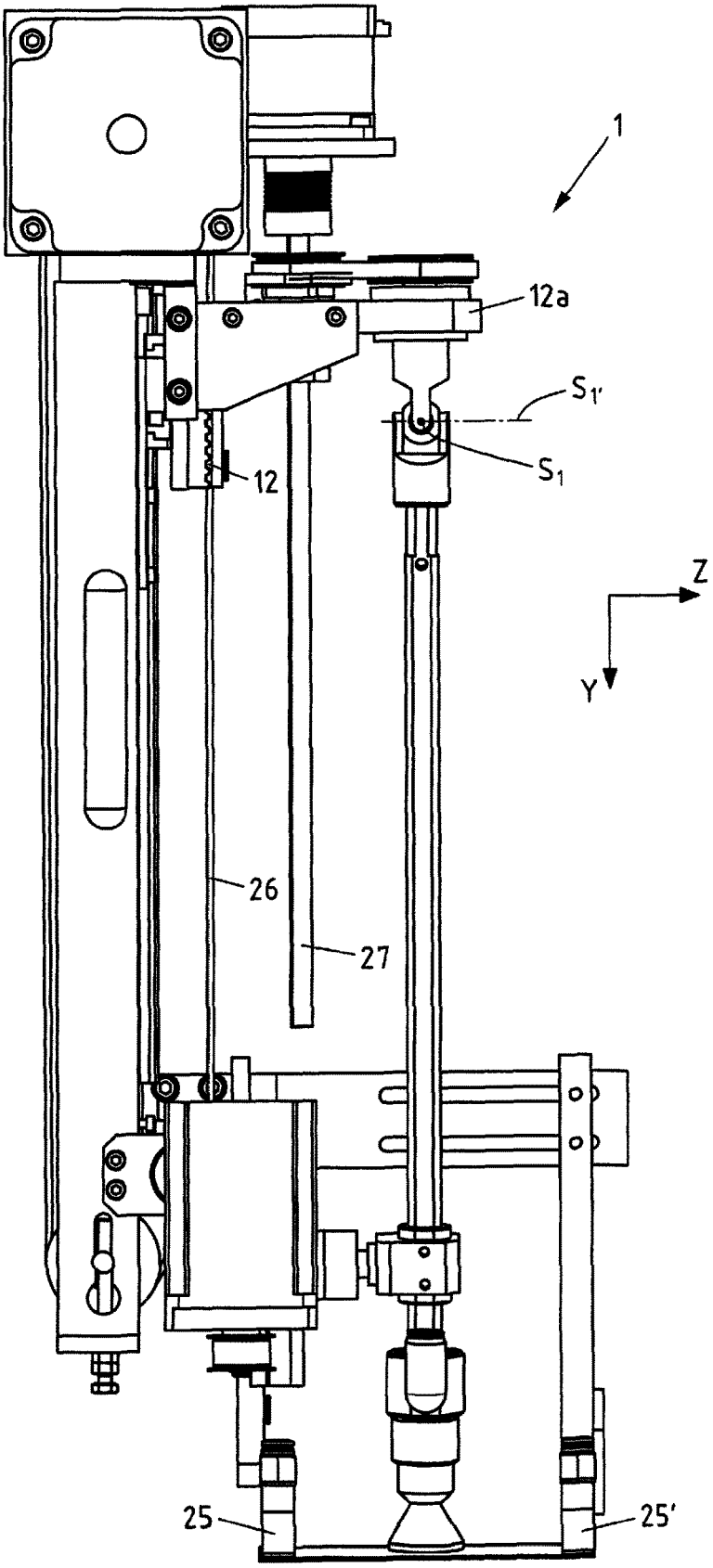

FIGS. 1*b*), 2*b*), etc. furthermore show that the holding base 25 may comprise two skids 25 and 25' that are spaced apart from one another in the transverse direction Z, wherein each of said skids comprises a contact surface 24 or 24' for the dispensed label on its underside facing the feed mechanism 3. In this case, the skids 25 and 25' can be jointly displaced in the transverse direction Z by means of an exemplary holding rail 29. If so required, the distance between the skids 25 and 25' can also be varied manually, pneumatically or in a motor-driven fashion. The plunger 9 or the plunger shaft 7 can then likewise be aligned centrally relative to both skids 25 and 25' in the transverse direction Z.

In this way, an adaptation of the device 1 or the application unit 6 to different label widths can be realized such that the plunger base 8 can always pick up a label 5—with any label width—in the center (referred to the direction Z). It was already mentioned above that the device 1 or the application unit 6 can also be adapted to different label lengths. This can be achieved by individually positioning the plunger 9 or the plunger shaft 7 in the transport direction X or in the direction of the pivoting motion of the plunger shaft 7 for each label length such that the plunger base 8 can always pick up a label 5—with any label length—in the center (referred to the direction X).

Ultimately, the rotating apparatus 16 for rotating the plunger 9 and therefore the plunger base 8, which is integrally connected to the plunger shaft 7 in this case, about the longitudinal axis $A_2$ of the plunger shaft 7 is briefly described below. The rotational motion serves for aligning a label 5 adhering to the underside of the plunger base 8 and is therefore preferably carried out during the application motion of the plunger 9 (i.e. between the pick-up position and the delivery position). A backward rotation of the plunger 9 about the axis $A_2$ is not absolutely imperative during the return motion, but may basically also be carried out, if so required.

In order to carry out the rotational motion, the rotating apparatus 6 comprises a drive 17 with a motor 18. The motor consists of a stepping motor that allows a rotation of the joint 15 and therefore of the plunger 9 in 1° increments. According to FIG. 1*a*), the guide rod 27 is connected to the motor 18 of the rotating apparatus 16 in a rotationally rigid fashion such that the motor 18 can set the guide rod 27 in rotation. The rotational motion of the guide rod 27 is then transmitted to a driving wheel 30 and from there to a driven wheel 32 by means of a synchronous belt 31, wherein the driven wheel 32 is once again connected to the joint 15 in a rotationally rigid fashion. In this way, the rotational motion of the motor or the guide rod 27 is transmitted to the plunger 9.

Figure 2B:
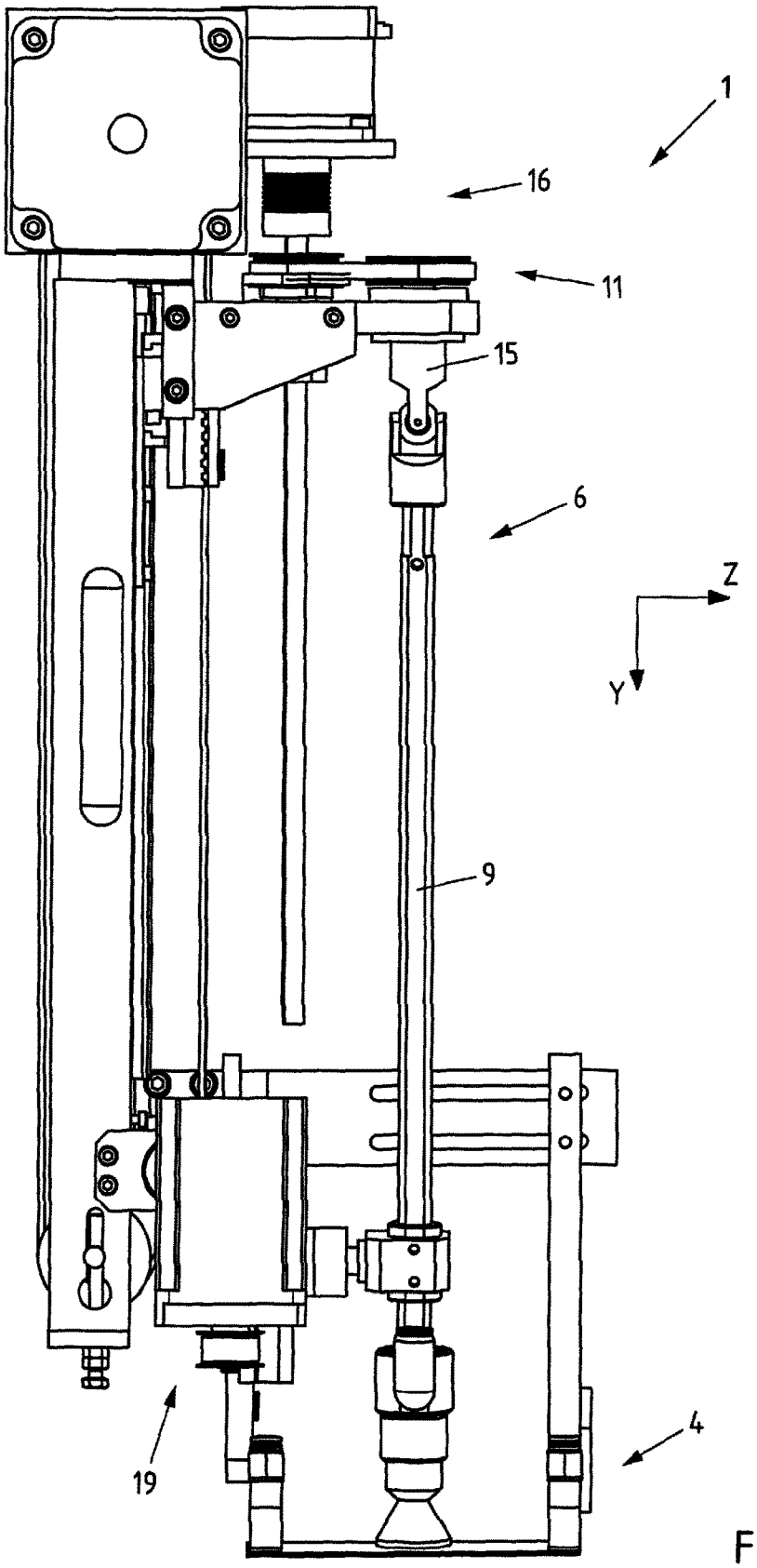
Figure 3B:
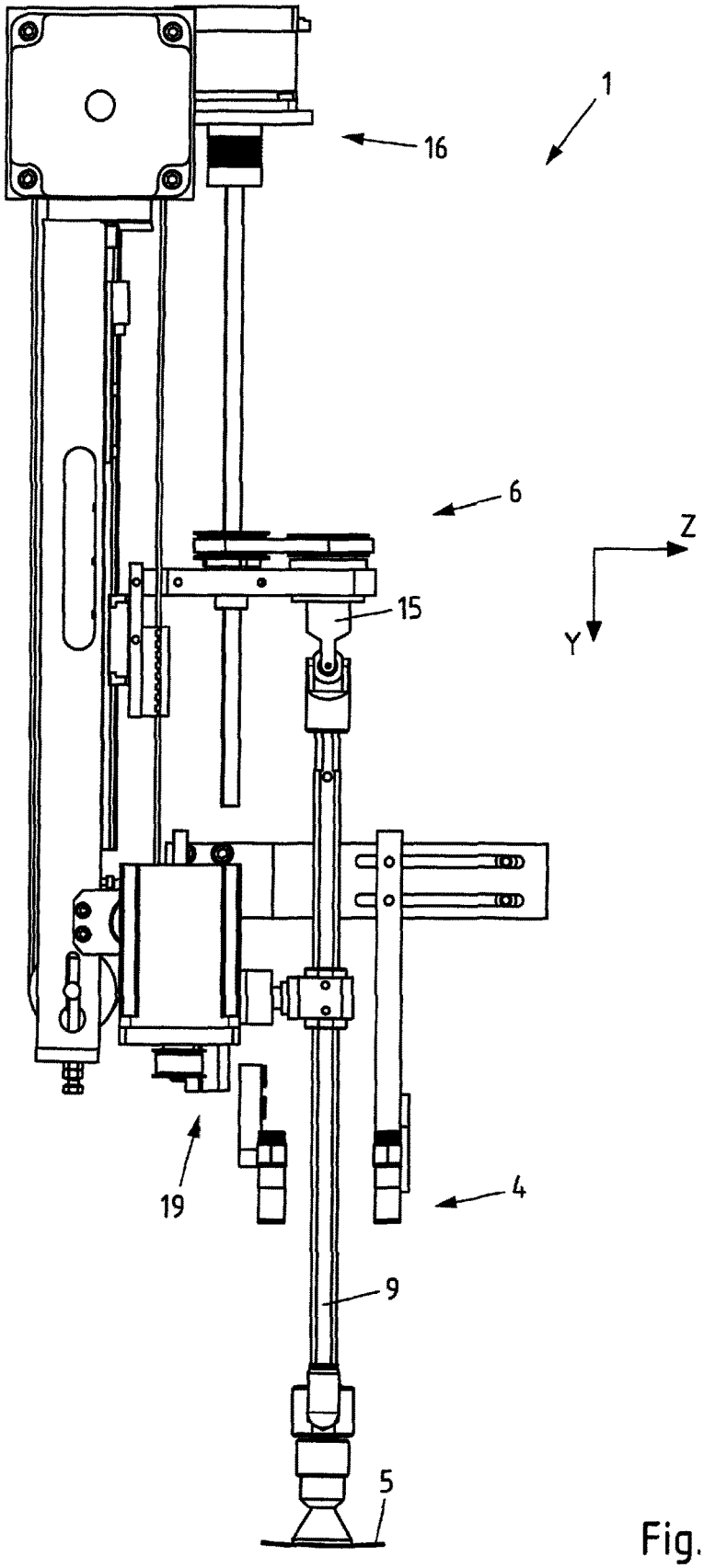

A comparison between FIGS. 1*b*), 2*b*) and 3*b*), etc. clearly shows that the driving wheel 30 and the driven wheel 32, as well as the synchronous belt 31, are jointly fastened on the section 12*a* of the lifting element 12 and can be moved in the Y-direction together therewith. The motor 18, in contrast, is immovably arranged relative to the motor 14 and therefore does not follow the lifting motion of the lifting element 12. Nevertheless, the described rotational motion can be transmitted from the motor 18 to the plunger 9 by means of the (rotatable) guide rod 27 in any position of the lifting element 12 relative to the guide rod 27 (FIG. 1*b*), FIG. 2*b*), FIG. 3*b*), etc.). The latter is realized in that the guide rod 27 is merely connected to the driving wheel 30 in a rotationally rigid fashion, but the driving wheel 30 nevertheless can be axially displaced relative to the guide rod 27 (together with the driven wheel 32 and the section 12*a* of the lifting element 12).

The invention claimed is:

1. A device for labeling individual packages comprising:

a feed mechanism for transporting a respective package in a transport direction (X), a dispensing unit for dispensing a label into a dispensing position, and an application unit for applying the dispensed label on the respective package, wherein the application unit comprises a plunger with a plunger shaft and a plunger base for moving the dispensed label from a pick-up position, in which the label is picked up by the plunger base, into a delivery position, in which the label can be applied on the package by the plunger base, wherein the plunger shaft is mounted such that it is pivotable about at least one first pivoting axis extending transverse to the transport direction (X), wherein the plunger shaft is axially movable in a guide element, which guide element is the only guide element for the plunger, wherein the application unit comprises a lifting apparatus with a lifting element, which is configured to carry out a reciprocating motion parallel to a direction (Y) extending angular to the transport direction (X), and a first drive with a motor that drives the lifting element, and wherein the plunger shaft of the plunger is connected to the lifting element of the lifting apparatus by means of a joint and wherein the guide element is movable in a reciprocating fashion parallel to the transport direction (X).

2. The device according to claim 1, wherein the plunger base is immovably connected to the plunger shaft.

3. The device according to claim 1, wherein the plunger base is detachably connected to the plunger shaft.

4. The device according to claim 1, wherein the plunger base is a suction and/or blow-off base.

5. The device according to claim 1, wherein the joint is a cardanic joint.

6. The device according to claim 1, wherein the plunger shaft and/or the plunger base and/or the joint are rotatably mounted about an axis, which extends in the direction (Y) that is aligned angular to the transport direction (X) and in which the lifting element is movable in a reciprocating fashion, and/or about a longitudinal axis of the plunger shaft.

7. The device according to claim 6, wherein the application unit further comprises a rotating apparatus with a second drive, which drives the joint or the plunger shaft or the plunger base.

8. The device according to claim 7, wherein the second drive comprises a motor, which is immovable relative to the motor of the first drive.

9. The device according to claim 8, wherein the joint and/or the plunger shaft and/or the plunger base is rotatable in increments between 0.5 and 2.5°.

10. The device according to claim 1, wherein the guide element is mounted such that it is pivotable about a second pivoting axis, which extends transverse to the transport direction (X) and is spaced apart from the joint and/or from the at least one first pivoting axis.

11. The device according to claim 1, wherein the guide element is movable in a reciprocating fashion parallel to the transport direction (X) together with the second pivoting axis, wherein the application unit comprises an adjusting apparatus with an adjusting element, which is movable in a reciprocating fashion parallel to the transport direction (X), and wherein a third drive with a motor drives the adjusting element.

12. The device according to claim 1, wherein the dispensing unit comprises a holding base for holding the dispensed label in the dispensing position and also in the pick-up position, wherein said holding base comprises at least one contact surface for the dispensed label on its side facing the feed mechanism.

13. The device according to claim 12, wherein the holding base comprises two skids, which are spaced apart from one another transverse to the transport direction (X), wherein each of said skids comprises a contact surface for the dispensed label on its side facing the feed mechanism.

14. The device according to claim 13, wherein the distance between the skids and/or between at least one of the skids and a plane, in which the plunger shaft carries out its pivoting motion, is variable in a direction (Z) extending transverse to the transport direction (X).

15. The device according to claim 14, wherein a part of the application unit, which is connected to the plunger, and/or the plunger is displaceable relative to the feed mechanism in the direction (Z) extending transverse to the transport direction (X).

16. The device according to claim 1, wherein the plunger base is realized in an exchangeable fashion.

17. A method for labeling individual packages using a device according to claim 1, wherein the plunger base, starting from the pick-up position, is directly moved in a direction extending angular to the transport direction (X) in order to apply the dispensed label, and wherein the plunger base is guided past a front side of the dispensing unit with respect to the transport direction (X) after the label has been applied on the package in the delivery position.

18. The method according to claim 17, wherein the plunger base is guided along a circulation path, which does not touch or intersect at any point during its entire motion from the pick-up position into the delivery position and back into the pick-up position.

19. The method according to claim 17, wherein the plunger base is spaced apart from the package by 1-60 mm in the direction (Y) extending angular to the transport direction (X) in order to transfer the label to the package, and wherein the plunger base particularly blows off the label on the package.

20. The method according to claim 17, wherein the plunger base is rotated about a longitudinal axis of the plunger shaft during its motion from the pick-up position into the delivery position and/or during its motion from the delivery position into the pickup position.

21. A method for labeling individual packages using a device according to claim 13, wherein the plunger base, starting from the pick-up position, is directly moved in a direction extending angular to the transport direction (X) in order to apply the dispensed label, and wherein the plunger base is guided past a front side of the dispensing unit with respect to the transport direction (X) after the label has been applied on the package in the delivery position, wherein the distance between the skids and/or between at least one of the skids and a plane, in which the plunger shaft carries out its pivoting motion, is varied in a direction (Z) extending transverse to the transport direction (X) before the plunger base comes in contact with the respective label.

* * * * *